US011540618B2

(12) United States Patent
Gillespie et al.

(10) Patent No.: US 11,540,618 B2
(45) Date of Patent: Jan. 3, 2023

(54) CLEANING BRUSH KIT AND METHODS

(71) Applicant: Zak Designs, Inc., Spokane, WA (US)

(72) Inventors: Andrew Gillespie, South Easton, MA (US); Seth Shepard, Spokane, WA (US)

(73) Assignee: Zak Designs, Inc., Spokane, WA (US)

( * ) Notice: Subject to any disclaimer, the term of this patent is extended or adjusted under 35 U.S.C. 154(b) by 271 days.

(21) Appl. No.: 16/902,828

(22) Filed: Jun. 16, 2020

(65) Prior Publication Data

US 2021/0386188 A1 Dec. 16, 2021

(51) Int. Cl.

| | |
|---|---|
| ***A46B 5/00*** | (2006.01) |
| ***A46B 3/00*** | (2006.01) |
| ***A46B 17/08*** | (2006.01) |
| ***A46B 9/00*** | (2006.01) |

(52) U.S. Cl.

CPC ..... *A46B 5/0095* (2013.01); *A46B 3/00* (2013.01); *A46B 5/002* (2013.01); *A46B 9/005* (2013.01); *A46B 17/08* (2013.01); *A46B 2200/3006* (2013.01); *A46B 2200/3013* (2013.01)

(58) Field of Classification Search

CPC ..... A46B 5/0095; A46B 5/002; A46B 3/00; A46B 17/08; A46B 5/004; A46B 11/06; A46B 2200/3006; A46B 2200/3013; A46B 9/005; A46B 9/025; A46B 9/028; A46B 2200/3073; A46B 9/02; B08B 9/027; B08B 9/032

USPC ..... 15/104.03, 104.012, 164, 211; D4/128, D4/133, 135

See application file for complete search history.

(56) References Cited

U.S. PATENT DOCUMENTS

| | | | | |
|---|---|---|---|---|
| 1,317,303 A * | 9/1919 | McDonnell | A46B 5/00 | 15/159.1 |
| 1,824,994 A * | 9/1931 | Dawson | A46B 5/00 | 15/164 |
| 2,727,267 A * | 12/1955 | Osgood | A46B 13/001 | 15/164 |
| 7,017,222 B2 * | 3/2006 | Dunn | A46B 5/0095 | D4/106 |

* cited by examiner

*Primary Examiner* — David J Walczak
(74) *Attorney, Agent, or Firm* — Randall Danskin P.S.

(57) ABSTRACT

A cleaning brush kit includes a bottle brush and a straw brush. The bottle-cleaning brush and the straw-cleaning brush are designed to be stored together with each other, but separable such that each can be used without the other. The bottle brush includes storage compartment in its handle to store the straw brush. The bottle brush head includes an upper ring and a lower ring of appendages designed to clean hard-to-reach areas of bottles. The straw brush includes a shaft and helical blade wrapped around the shaft.

20 Claims, 11 Drawing Sheets

CLEANING BRUSH KIT AND METHODS

FIELD

The present concept relates generally to a kit of cleaning brushes and related methods. More specifically, the present concept is concerned with a cleaning brush kit and related methods that involve a bottle-cleaning brush and a straw-cleaning brush, each designed to be stored together with the other, but separable such that each can be used without the other.

BACKGROUND

Those skilled in the art will recognize that various liquid dispensing containers in various sizes and shapes have been fabricated and sold over many decades. For many years, these liquid dispensing containers have been designed to meet the particular needs of the users during their various activities. For example, liquid dispensing containers have been specifically designed for assorted events such as running, bicycle riding, hiking, rock climbing, driving an automobile, attendance at sporting events, and the like. Much attention has been directed in these designs to providing a liquid dispensing vessel which permits a user to consume or dispense liquid from the container in a reliable manner during the activity, and which further prevents accidental spilling of the liquid from the container in the event that the drinking vessel is accidentally overturned.

With regard to the various shapes and configurations of drinking containers, one known and recurring problem is how to clean them after use so that they can be safe for reuse. Often, the neck or opening of the container is narrower than other components of the drinking container. Many examples of drinking containers include a shoulder, sides, and/or base or bottom that are wider than the neck or opening. Such configurations and shapes make it difficult to reach with a typical dish-cleaning brush. Several specialized tools have been developed to clean containers of specific shapes. Moreover, conventional bristles are rounded filaments that make contact with the surface to be cleaned at no more than one single linear edge, and often not even one linear edge. Often, the conventional rounded bristle makes contact with the cleaning surface at a small, round, non-linear edge and scrubbing the cleaning surface requires considerable agitation to remove debris and clean the entire cleaning surface.

Drinking straws have similar problems. Because drinking straws are often very narrow, it can be difficult to thoroughly clean the straw's interior. Debris can become lodged inside the straw, blocking or partially blocking fluid flow. Many straws are too narrow for ordinary dish-cleaning brushes to effectively clean. Some specialized straw-cleaning brushes have been developed.

Thus, to appropriately clean any drinking container that includes a straw, a user is faced with using multiple, separate, specialized cleaning tools. Providing a different option for such cleaning without the limitations of known tools would be beneficial.

SUMMARY

According to one apparatus, a cleaning brush kit includes a bottle brush and a straw brush. The bottle brush includes a handle located at the proximal end of the bottle brush. The bottle brush handle also includes a storage compartment. The bottle brush handle storage compartment is sized, shaped, and configured to receive at least a portion of the straw brush. The portion of the straw brush that is received into the storage compartment is enclosed within the storage compartment. The bottle brush includes a brush head at the distal end. The bottle brush head includes several upper appendages. The upper appendages are arranged to form an upper ring. The bottle brush head also includes several lower appendages. The lower appendages are arranged to form a lower ring. The straw brush includes a straw brush handle at the proximal end. The straw brush also includes a shaft extending from the straw brush handle to the distal end. A helical blade wraps around the shaft of the straw brush.

In some embodiments, the bottle brush head also includes several middle appendages arranged to form one or more middle ring. In some embodiments, the upper appendages curve upward toward the proximal end and away from the distal end. In some embodiments, the lower appendages curve downward toward the distal end and away from the proximal end. In some embodiments, the upper appendages are uniform in size and shape. In some embodiments, the lower appendages are uniform in size and shape. In some embodiments, the middle appendages are uniform in size and shape.

In some embodiments, the bottle brush includes one or more nozzle located at the bottle brush head. In some embodiments, the bottle brush includes a fluid flow chamber in the handle, sized and shaped to contain a volume of fluid. The fluid flow chamber is in fluid flow connection with the nozzle(s). In some embodiments, the fluid flow chamber includes a connection feature sized and shaped to connect to a hose or a fluid delivery system. In some embodiments, the bottle brush handle includes a window sized and shaped such that a user can observe the storage compartment through said window.

According to one method, cleaning a bottle and straw includes providing a bottle brush and straw brush as described above. The bottle brush includes a handle located at the proximal end of the bottle brush. The bottle brush handle also includes a storage compartment. The bottle brush handle storage compartment is sized, shaped, and configured to receive at least a portion of the straw brush. The portion of the straw brush that is received into the storage compartment is enclosed within the storage compartment. The bottle brush includes a brush head at the distal end. The bottle brush head includes several upper appendages. The upper appendages are arranged to form an upper ring. The bottle brush head also includes several lower appendages. The lower appendages are arranged to form a lower ring. The straw brush includes a straw brush handle at the proximal end. The straw brush also includes a shaft extending from the straw brush handle to the distal end. A helical blade wraps around the shaft of the straw brush. The method involves separating the straw brush from the bottle brush, inserting the bottle brush into a bottle, moving the bottle brush rotationally or longitudinally relative to the bottle, removing the bottle brush from the bottle, inserting the straw brush into a straw, moving the straw brush rotationally or longitudinally relative to the straw, removing the straw brush from the straw, and re-inserting the straw brush into the storage compartment of the bottle brush.

The foregoing paragraphs of the Summary are intended to be illustrative and are not meant in a limiting sense. Many possible embodiments of the present concept may be made and will be readily evident upon a study of this specification and accompanying drawings comprising a part thereof. Various features and subcombinations of present concept may be employed without reference to other features and subcombinations. Benefits of the present concept will become apparent from the description set forth in this specification taken in connection with the accompanying drawings, wherein is set forth by way of illustration and example, one or more embodiment(s) of the present concept and various features thereof.

BRIEF DESCRIPTION OF THE DRAWINGS

One or more embodiments are shown in the drawings. The drawings are not intended to limit the scope of the invention or claims in any way. The drawings shall be interpreted as illustrative and not in a limiting sense.

DETAILED DESCRIPTION

As required, one or more embodiment(s) of the present concept are disclosed herein and described in detail; however, it is to be understood that the disclosed embodiment(s) are merely examples, which may be embodied in various forms. Therefore, specific structural and functional details disclosed herein are not to be interpreted as limiting, but merely as a basis for the claims and as a representative basis for teaching one skilled in the art to variously employ the present concept in virtually any appropriately detailed structure.

A nearly universal cleaning brush kit that includes multiple specialized tools designed to clean hard-to-reach places in both container and straw is the subject matter of the present concept. The present concept includes, for example and not by way of limitation, the benefit that two cleaning tools can be stored together when not in use so as to avoid misplacing one or the other, ensuring that both tools are at hand, when needed.

Figure 1:
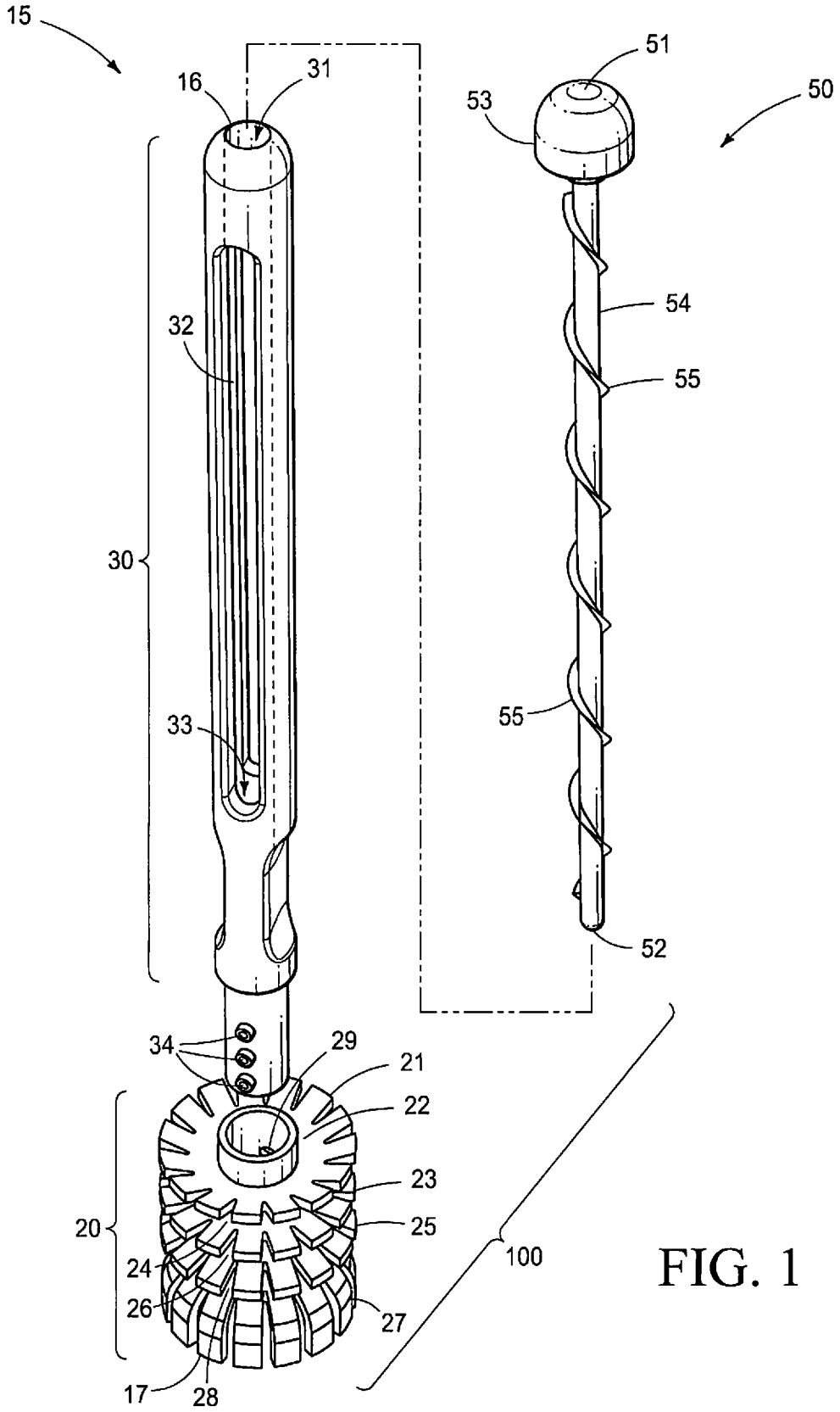
FIG. 1 is an exploded view of a cleaning brush kit.

Referring to FIG. 1, an exploded view of one embodiment of the cleaning brush kit 100 is shown. The cleaning brush kit 100 includes a bottle brush 15 and a straw brush 50. The bottle brush 15 includes a brush head 20 and a handle 30. For convenience, the bottle brush 15 is referred to as having a proximal end 16 and a distal end 17. The proximal end 16 is the end proximate to a user holding and operating the bottle brush 15, the end opposite the brush head 20. The distal end 17 is the end of the bottle brush 15 farthest away from the user, the end with the brush head 20. The proximal end 16 and distal end 17 of the bottle brush 15 are opposite one another.

Figure 6:
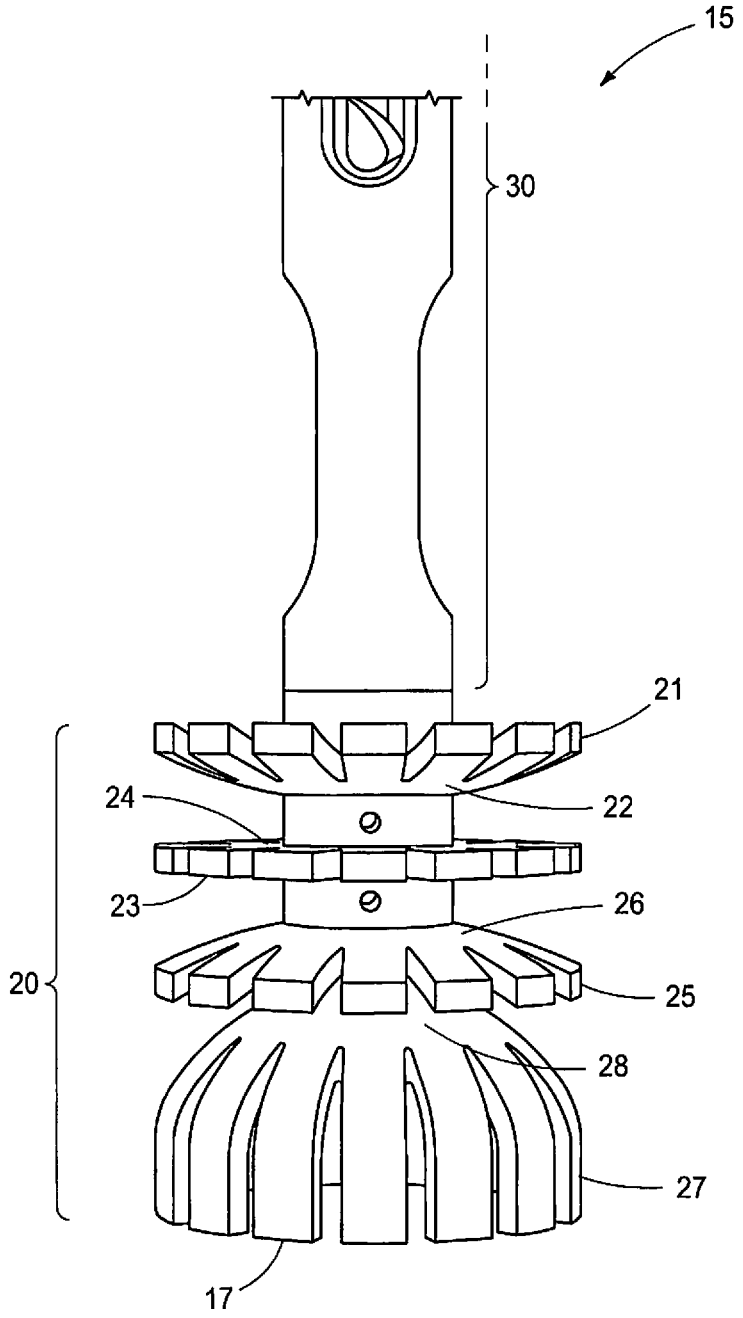
FIG. 6 is an enlarged view of the bottle brush head of a cleaning brush kit.

As shown in FIG. 1, the brush head 20 includes a plurality of appendages, which may also be described as bristles, fingers, or fins. The appendages of the brush head 20 are made of a flexible compound, for example, an elastomer, such as silicone, nylon, thermoplastic elastomer, or synthetic or natural rubber. The appendages need not be all uniform in size and shape. The structural design of each individual appendage takes inspiration from the wiping action of a windshield wiper blade and a squeegee used to clean windows. The appendage has two or more straight or linear edges which renders the cleaning action more effective than conventional round bristles. The two or more linear edges meet at various locations to form corners and angles sharper than 180 degrees. A cross section of the appendage has at least one straight line edge like a semi-circle or half-moon, and, in some embodiments is a polygon shape such as square, triangle, star, or hexagon. In some embodiments, the tip of the appendage is flat, as shown in FIG. 6. In some embodiments, not shown, the tip of the appendage is rounded. Each appendage uses its multiple linear edges in conjunction with rotational, lateral, and longitudinal motion to clean a vessel more effectively than conventional round bristles. The appendages may be arranged to curve upward, downward, or perpendicular to the long axis of the handle. The appendages of the brush head may be positioned and moved in a deliberate manner to target debris or specific surface to be cleaned. As effort is exerted and force is applied to the brush head, pressure is transferred to the vessel surface along the linear edges of the appendages and a squeegee-like or windshield wiper-like action is used to remove the targeted debris or to clean the targeted surface.

Figure 8:
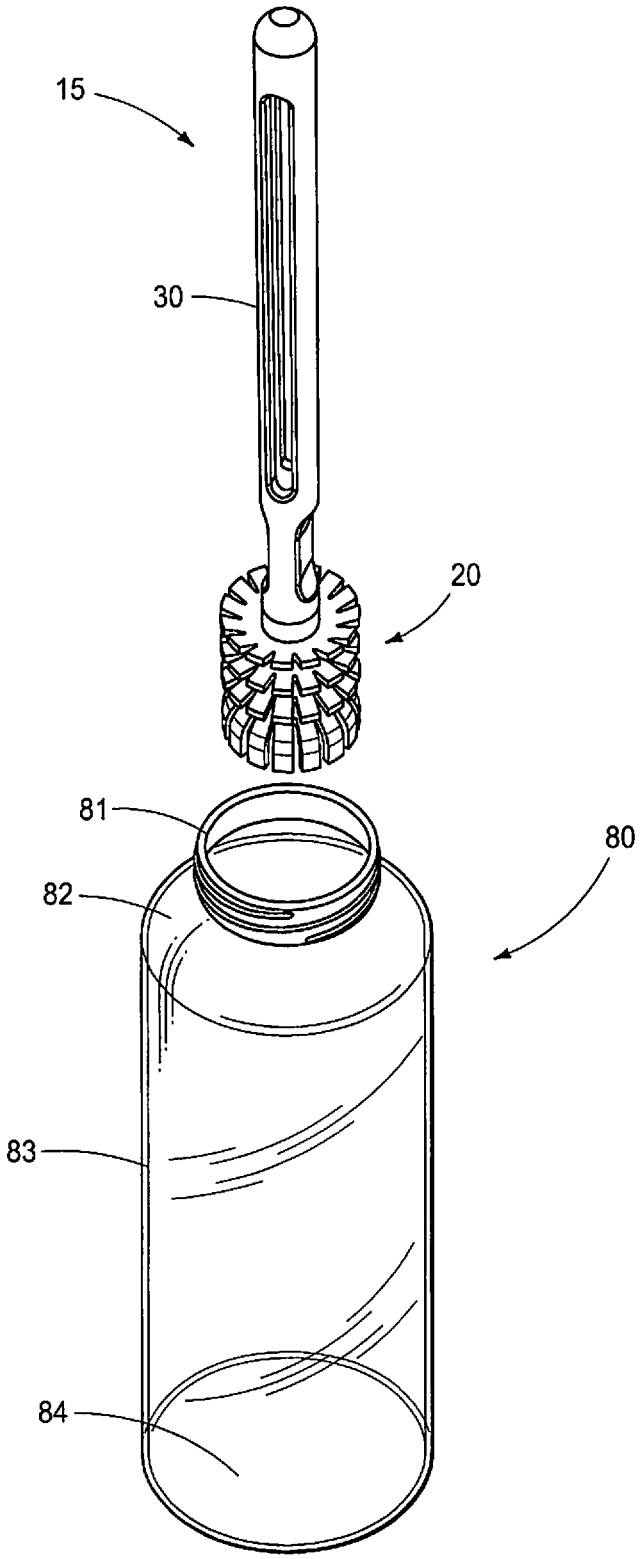
FIG. 8 is a perspective view of the bottle brush of a cleaning brush kit, before the bottle brush is inserted into a bottle.

The appendages are arranged to form a plurality of rings of appendages. For convenience, the rings are referred to in relative relation to the bottle brush 15 being used to clean an upright bottle 80 (shown in FIGS. 8, 9, and 10). In other words, for convenience, the rings are referred to as "upper," "middle," and "lower," with the upper ring being positioned farthest from the distal end 17 of the bottle brush 15 and the lower ring being positioned closest to the distal end 17 of the bottle brush 15.

Figure 7:
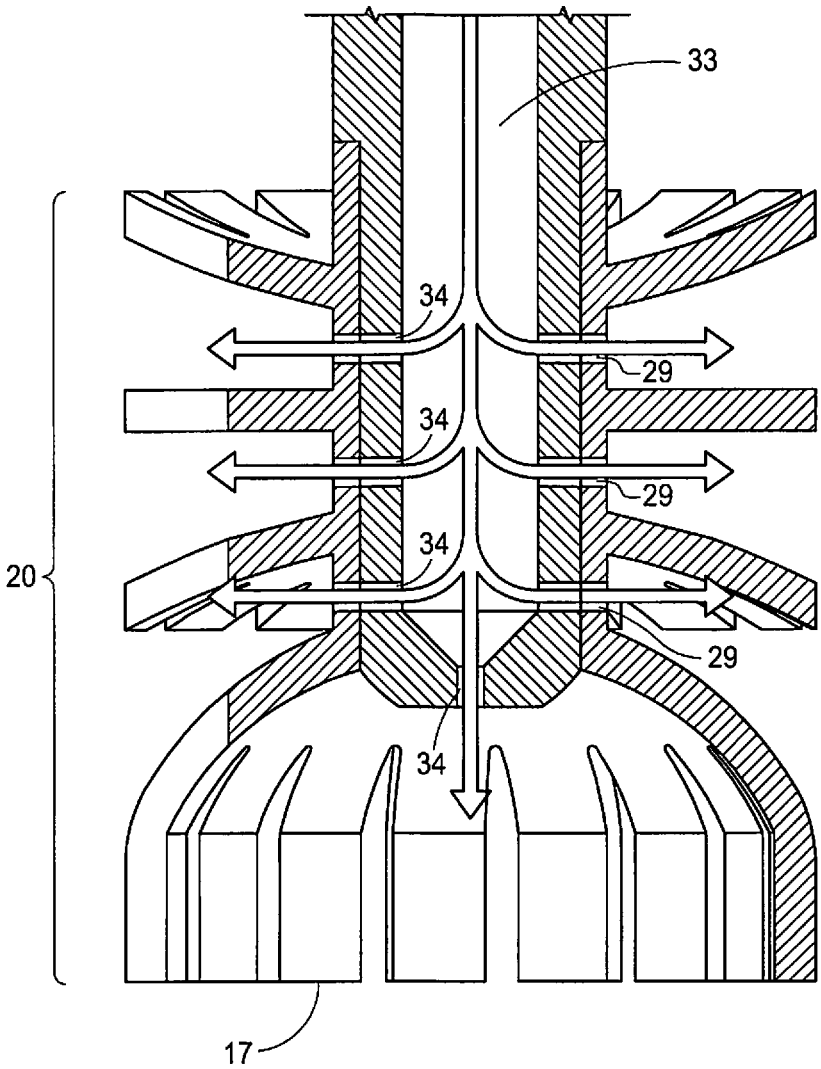
FIG. 7 is a lengthwise cross sectional view of the bottle brush head of a cleaning brush kit.

Referring to FIG. 1, and also as shown in FIGS. 6 and 7, a plurality of upper ring appendages 21 curve upward toward the proximal end 16 and away from the distal end 17. The upper ring appendages 21 are uniform in size and shape and arranged in the form of a ring. The ring of upper ring appendages 21 is the upper ring 22. As shown in FIGS. 1, 6, and 7, a plurality of first middle ring appendages 23 are uniform in size and shape and arranged to form a first middle ring 24. As shown in FIGS. 1, 6, and 7, a plurality of second middle ring appendages 25 curve downward toward the distal end 17 and away from the proximal end 16. The plurality of second middle ring appendages 25 are uniform in size and shape and arranged to form a second middle ring 26. As shown in FIGS. 1, 6, and 7, a plurality of lower ring appendages 27 curve downward toward the distal end 17 and away from the proximal end 16. The lower ring appendages 27 are uniform in size and shape and arranged to form another a lower ring 28. The appendages of each ring are different in size and shape from the appendages of the other rings. In other words, as shown in FIG. 1, the upper ring appendages 21 are different in size and shape from the other appendages (23, 25, and 27) that make up the brush head 20. Similarly, the first middle ring appendages 23 are different in size and shape from the other appendages (21, 25, and 27) and the second middle ring appendages 25 are different in size and shape from the other appendages (21, 23, and 27). Likewise, the lower ring appendages 27 are different in size and shape from the other appendages (21, 23, and 25) that make up the brush head 20.

Referring to FIG. 1, the handle 30 includes a compartment 31 sized and shaped such that at least a portion of the straw brush 50 can be inserted and stored within. The handle 30 may be made of a rigid material, such as plastic or stainless steel. As shown in FIG. 1, the straw brush 50 is sized and shaped such that it can be stored together with, and nested almost entirely enclosed within the compartment 31 of the handle 30 of, the bottle brush 15. In some embodiments, such as that which is shown in FIG. 1, the handle 30 includes a window 32 configured to assist a user to observe the compartment 31 and determine if the compartment 31 is obstructed or if the straw brush 50 is stored within. In some embodiments, such as the embodiment shown in FIG. 1, the handle 30 also includes one or more nozzle 34 in fluid connection with a fluid-flow chamber 33 that connects the nozzles 34 to the compartment 31.

Still referring to FIG. 1, the cleaning brush kit 100 includes a straw brush 50. The straw brush 50 has a proximal end 51 and a distal end 52. The proximal end 51 includes a handle 53. Connected to the handle 53 is shaft 54. In some embodiments, such as that shown in FIG. 1, the shaft 54 is elongated and cylindrical. One or more helical blade 55 wraps around the shaft 54. In some embodiments, such as that shown in FIG. 1, the helical blade 55 extends the entire length of the shaft 54 and has a consistent width throughout the entire length of the shaft 54. The handle 53 and shaft 54 may be made of the same rigid material as the bottle brush handle 30 and the helical blade 55 may be made of the same flexible compound as the appendages (21, 23, 25, and 27) of the bottle brush head 20.

Figure 2:
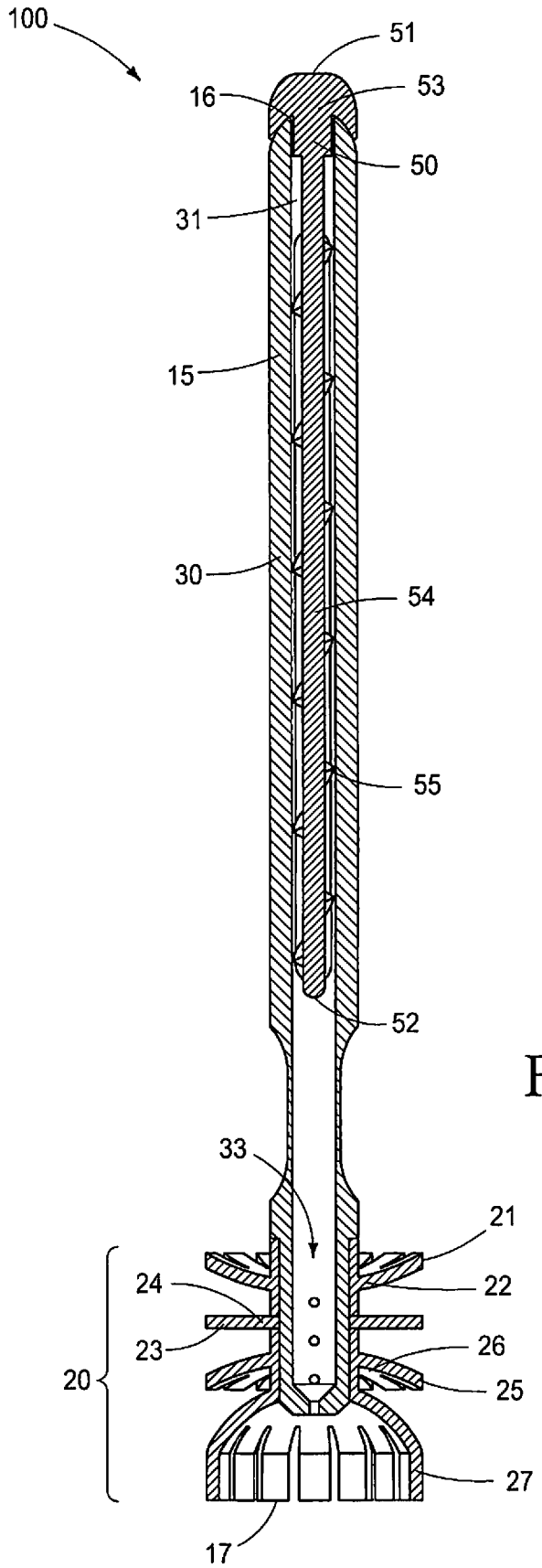
FIG. 2 is a lengthwise cross sectional view of a cleaning brush kit.

Referring to FIG. 2, a lengthwise cross section of the bottle brush 15 is shown. As shown in FIG. 2, the shaft 54 and helical blade 55 of the straw brush 50 are sized and shaped to fit within the bottle brush storage compartment 31 when in the stowed configuration. In the stowed configuration, a portion of the straw brush handle 53 rests outside the bottle brush storage compartment 31.

Figure 3:
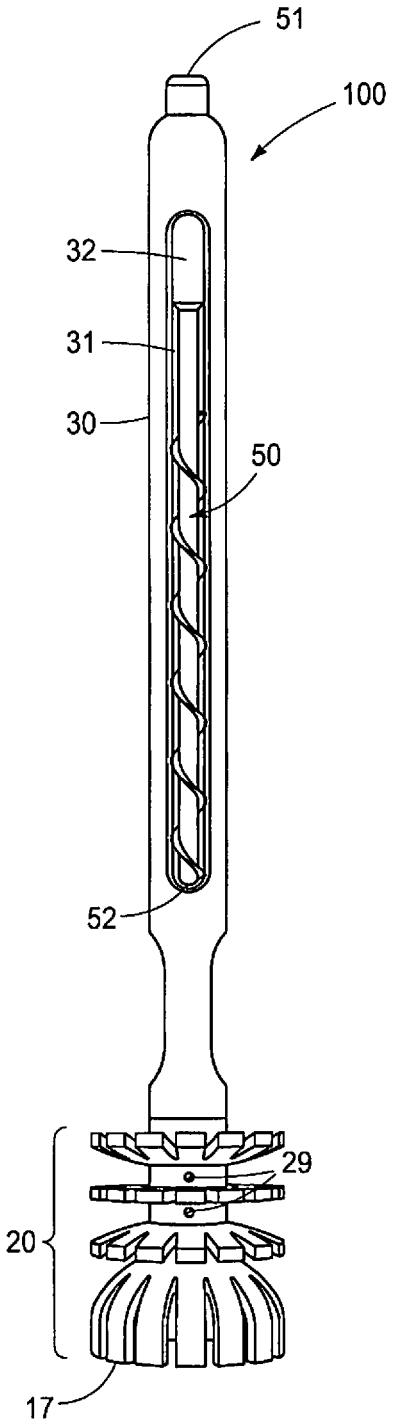
FIG. 3 is a side view of a cleaning brush kit.

FIG. 3 shows the straw brush 50 in the stowed configuration, stored within the bottle brush storage compartment 31. The straw brush 50 can be observed by a user through the bottle brush handle window 32. In some embodiments, the brush handle window 32 provides access to the fluid-flow chamber 33. In some embodiments, the fluid-flow chamber 33 is connected to the fluid supply through the brush handle window 32. In some embodiments, the window 32 allows for tap water from a faucet to enter the fluid-flow chamber 33 above the brush head 20 as the water flowing from the faucet hits the brush handle 30 during use. The window 32 allows for the interior of the brush handle 30 to be accessible and easily cleaned.

Figure 4:
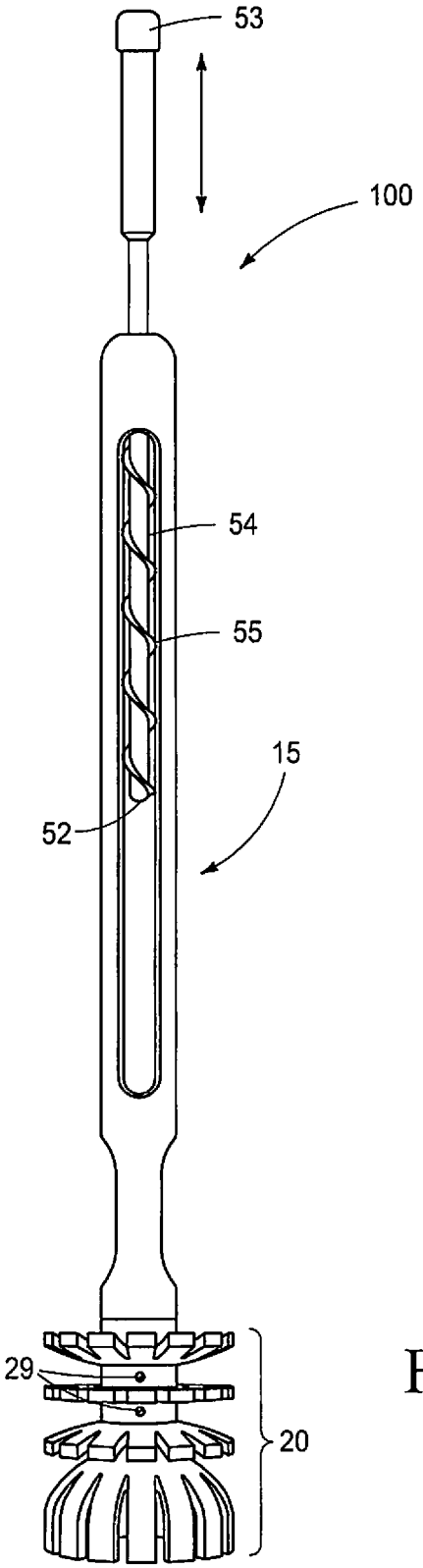
FIG. 4 is a side view of a cleaning brush kit with the straw brush partially removed.

FIG. 4 shows the straw brush 50 partially removed from the bottle brush storage compartment 31. The extent to which the straw brush 50 is inserted into the bottle brush storage compartment 31 can be observed via the bottle brush handle window 32. Through the bottle brush handle window 32, the user can observe and determine if the bottle brush storage compartment 31 is obstructed or if the straw brush 50 is removed from the bottle brush storage compartment 31.

Figure 5:
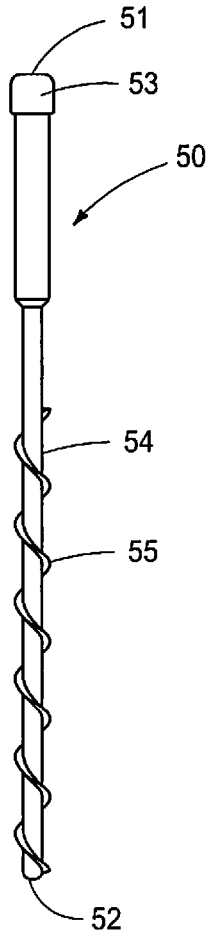
FIG. 5 is a side view of a cleaning brush kit with the straw brush removed from the bottle brush.

FIG. 5 shows the straw brush 50 completely removed from the bottle brush storage compartment 31.

Referring to FIG. 6, an embodiment of the bottle brush head 20 is shown. As discussed above, the bottle brush head is comprised of a plurality of appendages and these appendages are arranged to form rings. The bottle brush head 20 includes a plurality of upper ring appendages 21 arranged to form upper ring 22 and a plurality of lower ring appendages 27 arranged to form lower ring 28. Middle rings and middle ring appendages may be included. In FIG. 6, the plurality of upper ring appendages 21 curve upward away from the distal end 17. The upper ring appendages 21 are arranged in the form of upper ring 22. The plurality of first middle ring appendages 23 are arranged to form first middle ring 24. The plurality of second middle ring appendages 25 are arranged to form second middle ring 26. The plurality of lower ring appendages 27 curve downward toward the distal end 17. The lower ring appendages 27 are arranged to form lower ring 28.

In some embodiments, the appendages of one or more middle ring(s) are curved upward relative to the distal end 17 and, in some embodiments, the appendages of one or more middle ring(s) are curved downward relative to the distal end 17. As shown in FIG. 6, the first middle ring appendages 23 do not curve upward or downward and the second middle ring appendages 25 curve downward relative to the distal end 17. In some embodiments, the lower ring 28 of lower ring appendages 27 is designed to splay out under pressure to reach into bottom corners of the vessel. When the lower ring 28 is splayed out, rotational motion may be applied to wipe and clean the bottom corners of the vessel more effectively. In some embodiments, the upper ring 22 of upper ring appendages 21 curves upward relative to the distal end 17. The upward curve is configured to wipe and clean the upper corners and under the shoulder of the vessel, where, often, there is a relatively sharp transition or change in diameter from the neck to vessel sidewall. In some embodiments, the first middle ring 24 of first middle ring appendages 23 is straight and perpendicular to the long axis of the handle 30. The first middle ring appendages 23 are configured to provide a flexing action under pressure, as the user moves the brush head 20 up and down the sidewall of the bottle. In some embodiments, the second middle ring 26 of second middle ring appendages 25 curves downward toward the distal end 17 to assist in cleaning the lower areas of the vessel sidewall and/or any irregular interior vessel surface, such as that which may be found in a blow-molded novelty character bottle.

Referring to FIG. 7, a cross section of the bottle brush head 20 is shown. The bottle brush head 20 includes one or more nozzle outlet 29 through which the handle nozzle(s) 34 extend. The one or more nozzle outlet 29 is also shown in FIGS. 1, 3, 4, and 6. The handle 30 includes one or more nozzle 34 in fluid connection with a fluid-flow chamber 33 that connects the nozzles 34 to the compartment 31. The one or more nozzle 34 is also shown in FIG. 1. The arrows shown in FIG. 7 indicate the path of fluid flow. In the embodiment shown in FIG. 7, the bottle brush 15 is configured to be connected to a supply of fluid (not shown) such that fluid flows through at least a portion of the bottle brush handle storage compartment 31 (not shown in FIG. 7) into the fluid-flow chamber 33 and out through the one or more nozzles 34. In some embodiments, the fluid supply is pressurized. In some embodiments, the fluid supply is ordinary tap water from a faucet. In some embodiments, the fluid supply includes a cleaning agent. In some embodiments, the bottle brush 15 is configured to be connected to the fluid supply via a hose and fluid connectors. Connecting the cleaning fluid directly to the bottle brush 15 is beneficial in more directly delivering fluid to the cleaning head. If the directly connected fluid supply is under pressure, it provides a plurality of fluid jets out the nozzles 34 to assist in removing debris in conjunction with the action of the appendages when being rotated and moved up and down and side-to-side around the bottle. In some embodiments, the bottle brush 15 includes a fluid connector configured to provide a fluid connection with the fluid supply or a hose that is configured to be attachable in fluid connection with the fluid supply.

In some embodiments, such as those shown in FIGS. 2 and 7, the bottle brush head 20 and the bottle brush handle 30 are co-molded and chemically bonded to one another. In some embodiments, such as those shown in FIGS. 2 and 7, each nozzle 34 is aligned with a corresponding nozzle outlet 29 such that fluid may flow freely through the nozzle 34 and correspondingly aligned nozzle outlet 29 and does not obstruct or limit fluid flow through the other.

Figure 13:
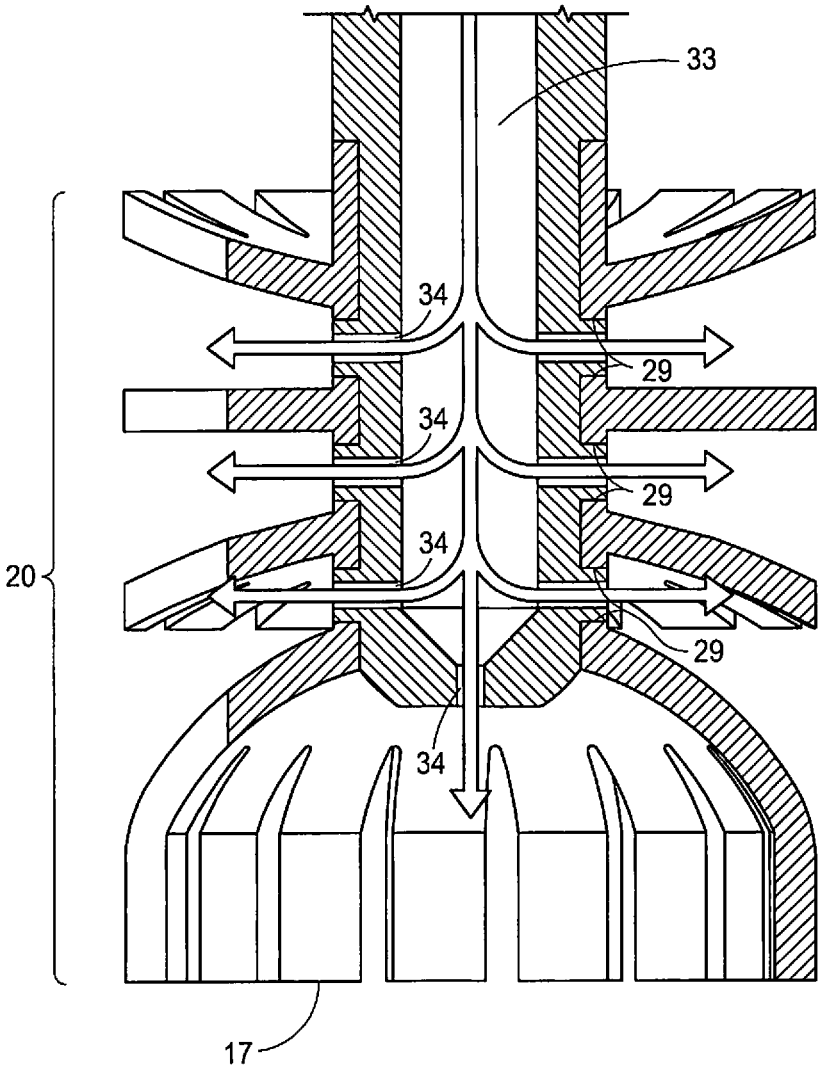
FIG. 13 is a lengthwise cross sectional view of the bottle brush head of the bottle brush of a cleaning brush kit.

In some embodiments, such as those shown in FIGS. 1 and 13, the bottle brush head 20 is removable from and replaceable to the bottle brush handle 30. In some embodiments, such as those shown in FIGS. 1 and 13, the nozzle 34 is sized and shaped such that it protrudes outward away from the bottle brush handle 30. In some such embodiments, the nozzle 34 is smaller than at least a portion of the nozzle outlet 29 and the nozzle 34 may be configured to extend at least partially into the bottle brush head 20 at the nozzle outlet 29. In some embodiments, a plurality of differently sized and shaped bottle brush heads 20 may be removed from and replaceable to the bottle brush handle 30. In some such embodiments, each nozzle 34 is sized and shaped to align and mate with a correspondingly sized and shaped nozzle outlet 29, which temporarily securely attaches the bottle brush head 20 to the bottle brush handle 30 and permits fluid flow through the nozzle 34 and nozzle outlet 29. In some embodiments, the bottle brush handle 30 and the bottle brush head 20 include mating ring and corresponding notch sized and shaped to temporarily securely attach the bottle brush head 20 to the bottle brush handle 30. In some embodiments, corresponding mating bevel edges are used to temporarily securely attach the bottle brush head 20 to the bottle brush handle 30. In some embodiments, protrusions and corresponding mating depressions are used to temporarily securely attach the bottle brush head 20 to the bottle brush handle 30. In some embodiments, one or more nozzle 34 and/or one or more nozzle outlet 29 is sized and shaped to restrict fluid flow.

Operation

The operation of the described embodiment(s) of the present concept is believed to be readily apparent, and is briefly summarized at this point.

The bottle brush 15 is used to clean the interior of a vessel, such as a bottle and lid. In the example shown in FIG. 8, the bottle 80 to be cleaned includes a neck 81, a shoulder 82, a side 83, and a bottom 84. The neck 81, shoulder 82, side 83, and bottom 84 of the bottle 80 are configured to form a leak-free interior chamber that will hold fluid when fluid is poured in through the neck 81. In the example shown in FIG. 8, the shoulder 82 and side 83 are wider than the neck 81. This size disparity makes it difficult to clean the interior chamber of the bottle 80 at the shoulder 82 and where the side 83 connects to the shoulder 82 to where the shoulder 82 connects to the neck 81. As further shown in FIG. 8, the angle at which the side 83 connects to the bottom 84 makes it difficult to clean this area as well.

Figure 9:
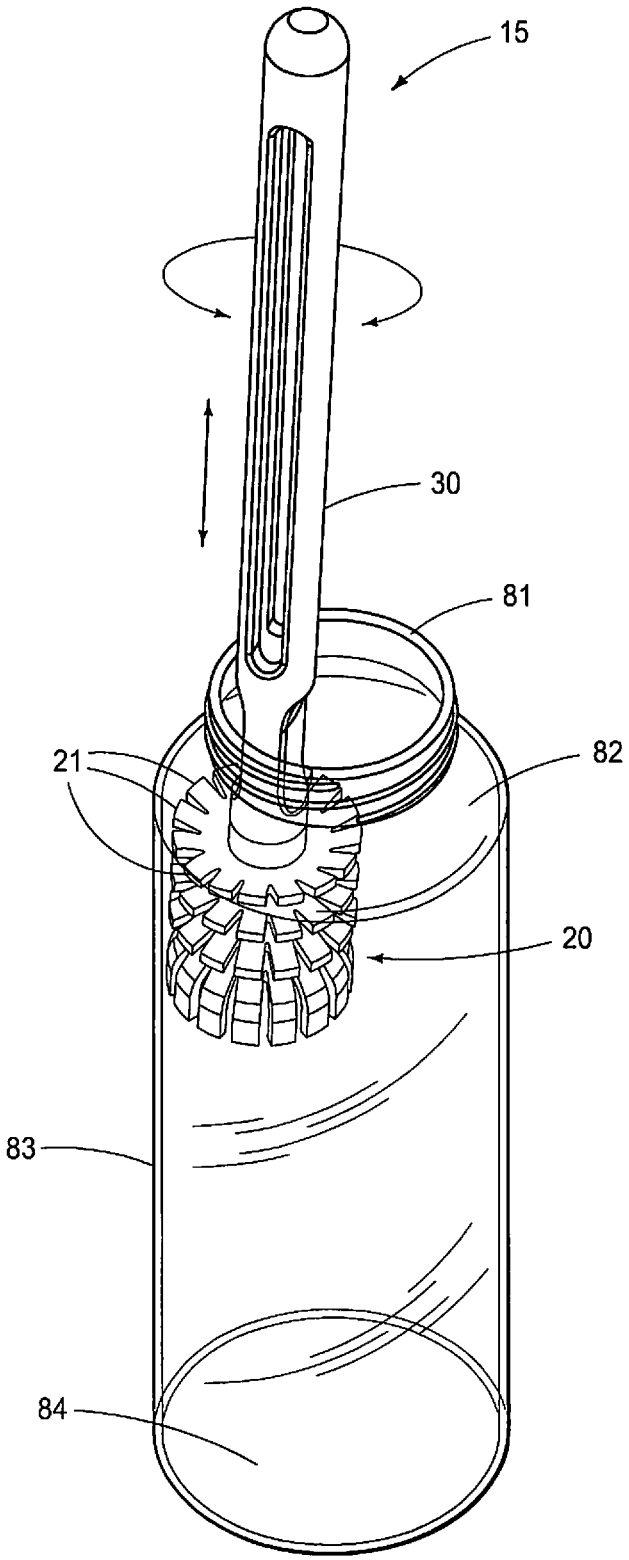
FIG. 9 is a perspective view of the bottle brush of a cleaning brush kit, the bottle brush partially inserted into a bottle, with the upper appendages pressed against the bottle shoulder and upper side and with arrows indicating longitudinal, lateral, and rotational motion used to clean the bottle.

Referring to FIG. 9, the distal end 17 of the bottle brush 15 is inserted into the bottle 80 via the neck 81. A cleaning liquid, such as water, soap, or soap and water may be poured into the interior chamber of the bottle 80. The bottle brush head 20 is pressed against the shoulder 82 and side 83. The bottle brush head 20 is rotated about the central long axis and/or in a circular motion around the shoulder 82 and side 83. The upper head appendages 21, with their upward curvature, are scraped along the interior chamber along the shoulder 82 and side 83. The upper brush head appendages 21 are arranged such that the entire interior surface area of the shoulder 82, from the side 83 to the neck 81, are wiped by one or more upper head appendages 21. The wiping motion of the appendages 21 along the shoulder 82, side 83, and neck 81 removes unwanted debris and disperses cleaning fluid over the interior surfaces of the bottle 80.

As the bottle brush head 20 is continually rotated around the interior surface of the side 83, moving up and down the entire length of the bottle 80, the appendages (21, 23, 25, and 27) are pressed against the side 83, thus wiping the interior surfaces of the side 83 of the bottle 80.

Figure 10:
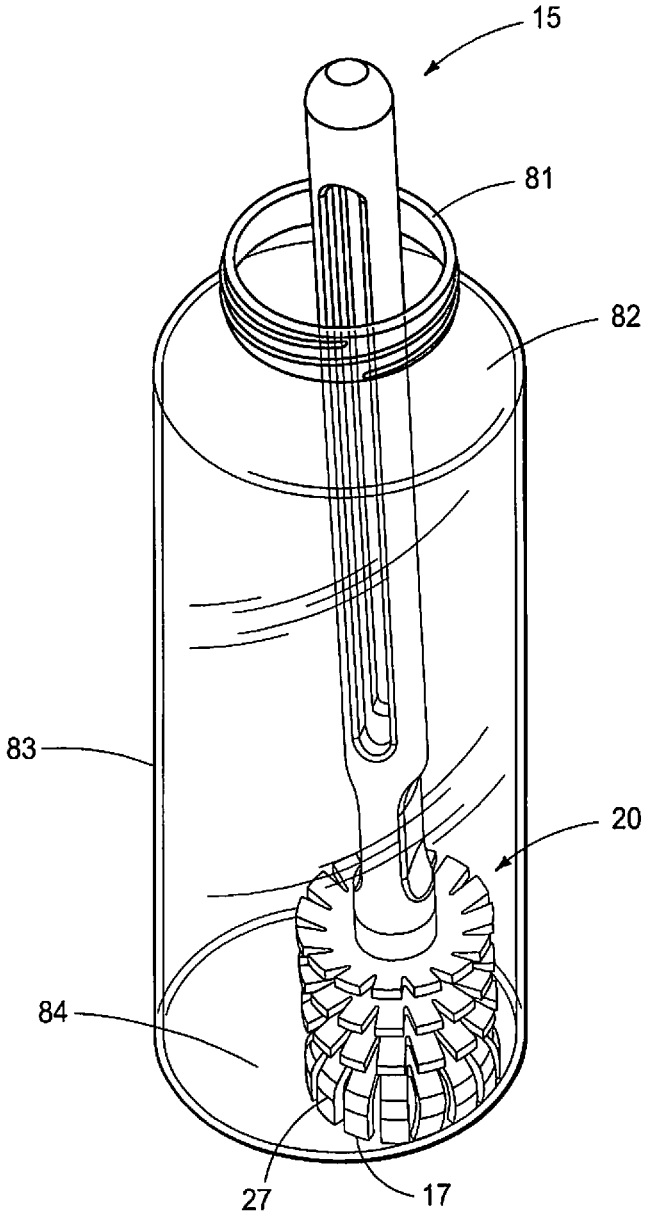
FIG. 10 is a perspective view of the bottle brush of a cleaning brush kit, the bottle brush inserted into a bottle, with the lower appendages pressed against the bottle bottom and lower side.

Referring to FIG. 10, the bottle brush 15 is inserted into the bottle 80 such that the distal end 17 and the lower brush head appendages 27 are pressed against the side 83 and bottom 84. The bottle brush head 20 is rotated about the central long axis and/or in a circular motion around the side 83 and bottom 84. The lower brush head appendages 27, with their downward curvature, are scraped along the interior chamber along the side 83 and bottom 84. The lower brush head appendages 27 are arranged such that the entire interior surface area of the side 83 and bottom 84 are wiped by one or more lower head appendages 27. The wiping motion of the appendages 27 along the side 83 and bottom 84 removes unwanted debris and disperses cleaning fluid over the interior surfaces of the bottle 80.

In some embodiments, the straw brush 50 is removed from the bottle brush storage compartment 31 before the bottle brush 15 is inserted into the bottle 80. In some embodiments, a fluid supply is connected to the bottle brush 15 and fluid is directed through at least a portion of the bottle brush handle storage compartment 31 into the fluid-flow chamber 33 and out through the one or more nozzles 34.

Figure 11:
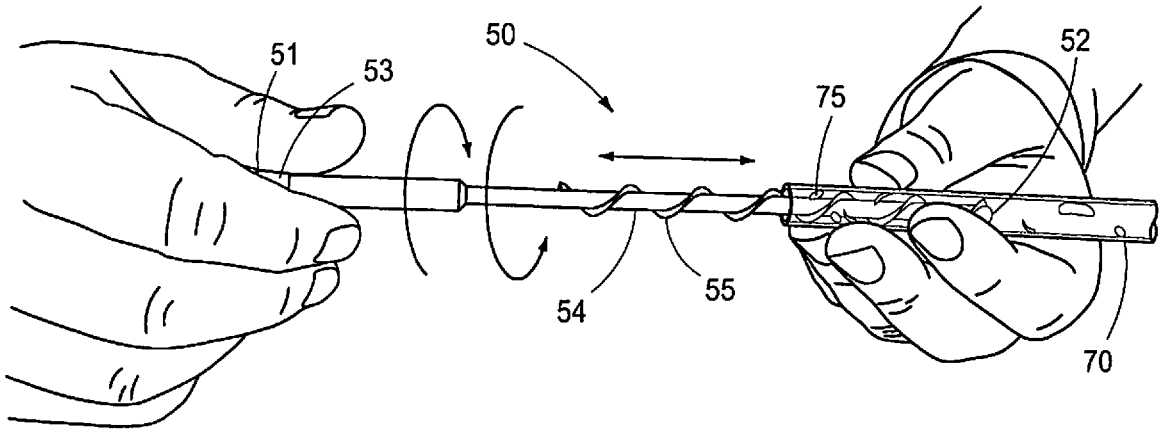
FIG. 11 is a perspective view of the straw brush of a cleaning brush kit and demonstrating longitudinal and rotational motion used to clean a straw.

Referring to FIG. 11, the straw brush 50 is removed from the bottle brush storage compartment 31. The user holds the straw brush 50 by the handle 53 at the proximal end 51 and inserts the distal end 52 into the straw 70. The straw brush 50 is continually rotated within the straw to remove debris 75 and clean the interior surface of the straw 70. The shaft 54 and helical blade 55 functions similar to an Archimedes screw to move debris along the length of the straw 70 via rotational motion. The shaft 54 and helical blade 55 are also moved laterally, in and out of the straw 70, to clean the interior surface of the straw 70 and clear debris 75. When the straw 70 is clean, the straw brush 50 is removed, cleaned, dried, and returned to its stowed configuration in the bottle brush storage compartment 31.

Figure 12:
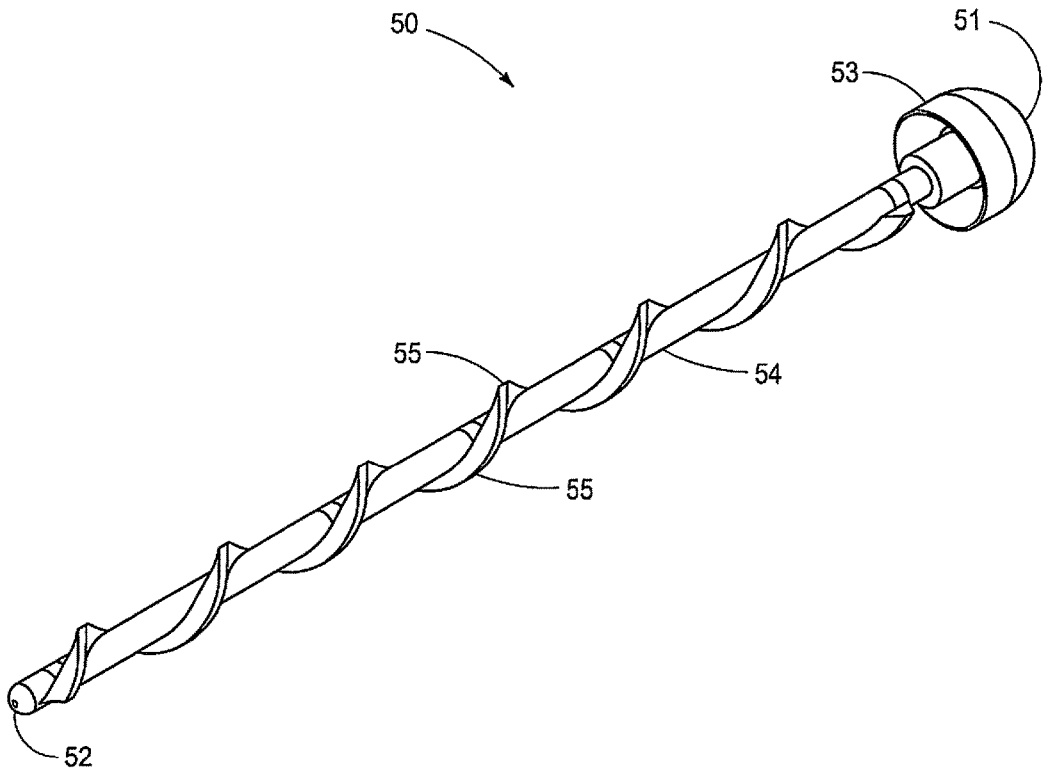
FIG. 12 is a perspective view of the straw brush of a cleaning brush kit.

In some embodiments, such as those shown in FIGS. 1, 3, 4, 5, and 11, the helical blade 55 comes to a point or single edge at its outermost point or, in other words, a cross-section of the helical blade 55 is a triangle. In some embodiments, such as that shown in FIG. 12, the helical blade 55 is flat at its outermost side, outermost being distal relative to the shaft. In some embodiments, the helical blade 55 includes a cross-section that is in the shape of a trapezoid or square. In some embodiments, the helical blade 55 has a leading outside edge and a trailing outside edge, the outside edge being distal relative to the shaft.

In some embodiments, a bottle and straw may be cleaned using the following method. A bottle brush and a straw brush are provided. The bottle brush and straw brush provided are as previously herein described. The straw brush is separated or removed from the bottle brush. The bottle brush is inserted into the bottle. In some embodiments, cleaning fluid is added to the bottle. The bottle brush is moved in a manner that is rotational, lateral, or longitudinal relative to the bottle. Pressure is applied such that the lower appendages of the bottle brush head splay out against the bottom of the bottle. Additional rotational, lateral, and/or longitudinal motion is applied, as needed. Pressure is applied such that the upper appendages reach into the bottle shoulder and all other interior surfaces of the bottle and clean and wipe away any debris. The bottle brush is removed from the bottle. The straw brush is inserted into the straw. In some embodiments, cleaning fluid is added to the straw. The straw brush is rotated. Debris that is lodged on the interior surface of the straw is wiped away by the helical blade of the straw brush. As the straw brush is continually rotated, the removed debris is moved toward the proximal end of the straw brush and, eventually, removed from the straw via the straw brush blade. Additional rotational, lateral, and/or longitudinal motion is applied, as needed. The straw brush is removed from the straw. The straw brush is returned to the storage compartment of the bottle brush. In some embodiments, the bottle and/or the straw are further rinsed with cleaning fluid. In some embodiments, the straw brush storage compartment is cleaned with a cleaning solution before the straw brush is returned to the storage compartment.

In some embodiments, the bottle brush head may be removed and/or replaced according to the following method. A bottle brush as previously herein described is provided. The bottle brush includes a bottle brush head and bottle brush handle configured such that the bottle brush head may be temporarily removed and reattached to the bottle brush handle. The bottle brush head is removed from the bottle brush handle. The bottle brush head is reattached to the bottle brush handle. In some embodiments, a second bottle brush head is provided and the second bottle brush head is attached to the bottle brush handle, replacing the first bottle brush head. In some embodiments, the bottle brush head nozzles are sized and shaped to protrude outward away from the bottle brush handle. The protruding nozzles are used to temporarily securely attach the bottle brush head to the bottle brush handle. In some such embodiments, the nozzles are smaller than at least a portion of the corresponding nozzle outlets. In some embodiments, the nozzles are configured to extend, at least partially, into the bottle brush head at the nozzle outlets. In some embodiments, a plurality of differently sized and shaped bottle brush heads may be removed from and replaceable to the bottle brush handle. In some such embodiments, each nozzle is sized and shaped to align and mate with a correspondingly sized and shaped nozzle outlet, which temporarily securely attaches the bottle brush head to the bottle brush handle and permits fluid flow through the nozzle and nozzle outlet. In some embodiments, the bottle brush handle and the bottle brush head include mating ring and corresponding notch sized and shaped to temporarily securely attach the bottle brush head to the bottle brush handle. In some embodiments, corresponding mating bevel edges are used to temporarily securely attach the bottle brush head to the bottle brush handle. In some embodiments, protrusions and corresponding mating depressions are used to temporarily securely attach the bottle brush head to the bottle brush handle.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

Finally, it will be appreciated that the purpose of the accompanying Abstract is to enable the patent offices and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the claims in any way.

What is claimed is:

1. A cleaning brush kit comprising:

a bottle brush; and a straw brush;

the bottle brush comprising:

a bottle brush handle at a proximal end of the bottle brush, said bottle brush handle further comprising a storage compartment sized and shaped to receive and enclose at least a portion of said straw brush; and a bottle brush head at a distal end of the bottle brush, said bottle brush head further comprising a plurality of upper appendages arranged to form an upper ring and a plurality of lower appendages arranged to form a lower ring, wherein said plurality of upper appendages curve upward toward the proximal end of the bottle brush and away from the distal end of the bottle brush; and the straw brush comprising:

a straw brush handle at a proximal end of the straw brush;

a shaft extending from the straw brush handle to a distal end of the straw brush; and a helical blade wrapped around the shaft.

2. The cleaning brush kit of claim 1, said bottle brush head further comprising a plurality of middle appendages arranged to form one or more middle ring.

3. The cleaning brush kit of claim 1, wherein said plurality of lower appendages curve downward toward the distal end of the bottle brush and away from the proximal end of the bottle brush.

4. The cleaning brush kit of claim 1, wherein said bottle brush handle further comprises a window sized and shaped such that a user can observe the storage compartment through said window.

5. The cleaning brush kit of claim 1, wherein one or more of said appendages includes two or more straight edges that meet together at a point to form an angle sharper than 180 degrees.

6. The cleaning brush kit of claim 1, wherein one or more of said appendages has a cross-section having a polygon shape.

7. The cleaning brush kit of claim 1, wherein the bottle brush handle and the bottle brush head are co-molded such that a chemical bond binds the bottle brush handle and the bottle brush head together.

8. The cleaning brush kit of claim 1, wherein the bottle brush handle and the bottle brush head are configured such that the bottle brush head may be temporarily removed and reattached to the bottle brush handle.

9. The cleaning brush kit of claim 1, wherein the helical blade has a single edge at an outermost side that is farthest away from the shaft.

10. The cleaning brush kit of claim 1, wherein the helical blade has a cross-section in the shape of a triangle.

11. The cleaning brush kit of claim 1, wherein the helical blade has a leading outside edge and a trailing outside edge at an outermost side, the outermost side being distal relative to the shaft.

12. The cleaning brush kit of claim 1, wherein the helical blade has a cross-section in the shape of a square.

13. A cleaning brush kit comprising:

a bottle brush; and a straw brush;

the bottle brush comprising:

a bottle brush handle at a proximal end of the bottle burhs, said bottle brush handle further comprising a storage compartment sized and shaped to receive and enclose at least a portion of said straw brush, wherein said bottle brush handle further comprises one or more nozzle and the bottle brush head further comprises one or more nozzle outlet, each of the one or more nozzle being sized, shaped, and positioned to align with a corresponding nozzle outlet, and the one or more nozzle and the corresponding nozzle outlet is configured to direct fluid flow out from the bottle brush handle; and a bottle brush head at a distal end of the bottle brush, said bottle brush head further comprising a plurality of upper appendages arranged to form an upper ring and a plurality of lower appendages arranged to form a lower ring; and the straw brush comprising:

a straw brush handle at a proximal end of the straw brush;

a shaft extending from the straw brush handle to a distal end of the straw brush; and a helical blade wrapped around the shaft.

14. The cleaning brush kit of claim 13, wherein said bottle brush handle further comprises a fluid flow chamber sized and shaped to contain a volume of fluid, said fluid flow chamber being in fluid flow connection with said one or more nozzle and corresponding nozzle outlet.

15. The cleaning brush kit of claim 14, wherein said fluid flow chamber further comprises a connection feature sized and shaped to connect to a hose or a fluid supply.

16. The cleaning brush kit of claim 13, wherein the one or more nozzle protrudes outward away from the bottle brush handle.

17. The cleaning brush kit of claim 13, wherein the one or more nozzle is sized sufficiently smaller than at least a portion of the corresponding nozzle outlet such that the one or more nozzle mates with the corresponding nozzle outlet to temporarily secure the bottle brush head relative to the bottle brush handle.

18. A bottle brush comprising:

a bottle brush handle at a proximal end of the bottle brush; and a bottle brush head at a distal end of the bottle brush, said bottle brush head further comprising a plurality of upper appendages arranged to form an upper ring and a plurality of lower appendages arranged to form a lower ring, said plurality of upper appendages curve upward toward the proximal end of the bottle brush and away from the distal end of the bottle brush, said plurality of lower appendages curve downward toward the distal end of the bottle brush and away from the proximal end of the bottle brush, and one or more of said appendages includes two or more straight edges that meet together at a point to form an angle sharper than 180 degrees.

19. A method of removing and replacing a bottle brush head, the method comprising:

providing a bottle brush of claim 18, wherein the bottle brush handle and the bottle brush head are configured such that the bottle brush head may be temporarily removed and reattached to the bottle brush handle;

removing the bottle brush head from the bottle brush handle;

providing a second bottle brush head; and attaching the second bottle brush head to the bottle brush handle.

20. A method of cleaning a bottle and straw, the method comprising:

providing a bottle brush and a straw brush, the bottle brush comprising:

a bottle brush handle at a proximal end of the bottle brush, said bottle brush handle further comprising a storage compartment sized and shaped to receive and enclose at least a portion of said straw brush; and a bottle brush head at a distal end of the bottle brush, said bottle brush head further comprising a plurality of upper appendages arranged to form an upper ring and a plurality of lower appendages arranged to form a lower ring; and the straw brush comprising:

a straw brush handle at a proximal end of the straw brush;

a shaft extending from the straw brush handle to a distal end of the straw brush; and a helical blade wrapped around the shaft;

separating the straw brush from the bottle brush;

inserting the bottle brush into a bottle;

moving the bottle brush rotationally or longitudinally relative to the bottle;

removing the bottle brush from the bottle;

inserting the straw brush into a straw;

moving the straw brush rotationally or longitudinally relative to the straw;

removing the straw brush; and inserting the straw brush into the storage compartment of the bottle brush.

* * * * *